US006101819A

United States Patent [19]

Onaka et al.

[11] Patent Number: 6,101,819

[45] Date of Patent: Aug. 15, 2000

[54] TEMPERATURE CONTROL DEVICE FOR REFRIGERATORS

[75] Inventors: Takeshi Onaka, Kurita-gun; Kouji Maeda; Yuji Kishinaka, both of Otsu; Takashi Aoki, Kusatsu; Masatoshi Sasaki, Kyoto, all of Japan

[73] Assignee: Matsushita Refrigeration Company, Higashiosaka, Japan

[21] Appl. No.: 09/051,128

[22] PCT Filed: Aug. 6, 1997

[86] PCT No.: PCT/JP97/02737

§ 371 Date: Sep. 15, 1998

§ 102(e) Date: Sep. 15, 1998

[87] PCT Pub. No.: WO98/05911

PCT Pub. Date: Feb. 12, 1998

[30] Foreign Application Priority Data

Aug. 7, 1996 [JP] Japan ..... 8-208155

[51] Int. Cl.[7] ..... F25B 49/00

[52] U.S. Cl. ..... 62/125; 62/126; 337/327

[58] Field of Search ..... 62/125, 126, 127; 337/327, 20, 34, 112, 380, 398, 414; 236/78 R, 78 A, DIG. 19

[56] References Cited

U.S. PATENT DOCUMENTS

| | | | |
|---|---|---|---|
| 2,192,852 | 3/1940 | Hastings | 200/138 |
| 2,262,025 | 11/1941 | Marcy | 200/138 |
| 2,262,027 | 11/1941 | Marcy | 200/83 |
| 2,327,014 | 8/1943 | Buller | 200/138 |
| 2,385,525 | 9/1945 | McCloy | 62/4 |
| 2,477,055 | 7/1949 | Giffard | 62/89 |
| 2,720,758 | 10/1955 | Anderson | 62/89 |
| 2,773,153 | 12/1956 | Verkuil | 200/138 |
| 3,101,922 | 8/1963 | Moody et al. | 248/27 |
| 3,288,896 | 11/1966 | Hendricks | 264/45 |
| 4,404,813 | 9/1983 | Paddock et al. | 62/127 |
| 4,560,972 | 12/1985 | Britt | 337/338 |
| 4,936,106 | 6/1990 | Beach, Jr. et al. | 62/131 |
| 5,177,976 | 1/1993 | Lim et al. | 62/131 |
| 5,488,347 | 1/1996 | Gurski | 337/380 |
| 5,640,856 | 6/1997 | Cho | 62/465 |

FOREIGN PATENT DOCUMENTS

| | | |
|---|---|---|
| 10 19 669 | 8/1957 | Germany . |
| 34 45 601 | 6/1986 | Germany . |
| 1065221 | 4/1967 | United Kingdom . |

*Primary Examiner*—Henry Bennett
*Assistant Examiner*—Marc Norman
*Attorney, Agent, or Firm*—Wenderoth, Lind & Ponack, L.L.P.

[57] ABSTRACT

A temperature control device is provided in a refrigerator having at least one compartment (RC or FC) defined by top, bottom and opposite side walls (TW; BW; and SW), and a heat insulating material (12) exteriorly encircling the compartment. One of the side walls (SW) has a mounting hole (2) defined therein and a front surface thereof confronts the compartment (RC or FC). The device includes a box-like console (C), and a circuit carrier board (3) fixedly connected to a rear surface of the console (C). Electric wiring (11) extends outwardly from the circuit carrier board, and a display panel (30) is disposed on a front surface of the console (C). At least one manipulatable temperature control element (31*a*, 31*b*, 31*c*: PB, LED) is mounted on the console (C), and a hat-like console casing (13) having a peripheral flange (10) is fixedly secured to the side wall (SW) in alignment with the mounting hole (2). The peripheral flange (10) is held in abutment with a rear surface of the side wall (SW) so as to define a console pocket (CP). Also, a plurality of mounting elements (6*a*, 6*b*; 55) are engaged with an outer surface of the side wall (SW) around the mounting hole (2) for securing the console (C) to the side wall (SW). The console (C) is received in the console pocket (CP) with the electric wiring (11) accommodated within the console pocket (CP) and with the display panel (30) and the temperature control element confronting the compartment.

16 Claims, 7 Drawing Sheets

TEMPERATURE CONTROL DEVICE FOR REFRIGERATORS

TECHNICAL FIELD

The present invention generally relates to refrigerators and, more particularly, to a temperature control unit used in the refrigerator to control the temperature inside the refrigerator.

BACKGROUND ART

A temperature control unit adapted for use in a refrigerator has been developed. By way of example, Japanese Patent Laid-open Publication No. 61-93375, published in 1986, discloses a temperature control unit installed in a rearmost wall of the refrigerating compartment such as shown in FIGS. 12 and 13, and the Japanese Patent Laid-open Publication No. 4-161779, published in 1992, discloses a temperature control unit installed outside the refrigerating compartment at a location between a freezer door and a refrigerator door such as shown in FIGS. 14 and 15.

The refrigerator generally comprises a rectangular box-like housing of a double-walled structure including outer and inner boxes with a heat insulating material 12 filled in a space between the outer and inner boxes. The refrigerator shown in FIGS. 12 and 13 is of a type wherein the inner box is divided into a freezing compartment FC adapted to be opened or closed selectively by a freezer door FD and a refrigerating compartment RC defined beneath the freezing compartment FC and adapted to be opened or closed selectively by a refrigerator door RD. The refrigerating compartment RC is delimited by top, bottom, rear and side walls, which form parts of the inner box 1 of the refrigerator housing, and the rear wall confronting the refrigerator door RD.

As shown in FIGS. 12 and 13, the prior art temperature control unit is accommodated, together with two temperature control knobs 23, in a control box 22 which is in turn mounted at a portion of the rear wall of the inner box 1 adjacent the top wall as best shown in FIG. 12. The temperature control knobs 23 are for the freezing compartment FC and for the refrigerating compartment RC, respectively, and each knob 23 has a radially extending finger-piece 23*a* formed integrally therewith. The temperature inside the freezing compartment FC or inside the refrigerating compartment RC can be adjusted by turning a corresponding one of the temperature control knobs 23 in either direction with the user grasping the associated finger-piece 23*a*.

The refrigerator shown in FIG. 14 is similar in structure to that shown in FIG. 12, but has a transverse trim box 7 fixed to a lower portion of the freezer door FD for movement together therewith. As best shown in FIG. 15, a generally elongated circuit carrier board 3 and a generally elongated control panel 9 are connected together by means of a plurality of set screws 4 and the resultant assembly is in turn accommodated within the trim box 7 together with a display panel 5. The trim box 7, accommodating the circuit carrier board 3, the control panel 9 and the display panel 5, is encased within and secured from below to the lower portion of the freezer door FD by means of set screws 25. In the assembled condition, the control panel 9 is covered by two slide door segments 27 each having a display window 26 defined therein.

Adjustment of the temperatures inside the freezing compartment and the refrigerating compartment can be accomplished by opening the associated slide door segments 27 so that the user can press adjustment buttons mounted on the control panel 9, respectively.

It has been found that the prior art temperature control units discussed above have the following problems.

Specifically in the case of the temperature control unit disclosed in the first-mentioned Japanese publication, the user is forced to assume an awkward posture so as to stoop down and then to extend his or her arm deep into the refrigerating compartment RC to reach the temperature control unit when he or she wishes to turn one or both of the temperature control knobs 23.

Also, when a region of the refrigerating compartment RC between the refrigerator door RD and the rear wall where the temperature control unit is installed is filled with foodstuffs to be refrigerated, access to the temperature control unit is difficult to accomplish unless the foodstuffs are removed. Moreover, considering that the temperature control box 22 is installed in a fashion protruding from the rear wall into the refrigerating compartment RC, the maximum space available for storing the foodstuffs tends to be limited.

On the other hand, in the case of the temperature control unit disclosed in the second-mentioned Japanese publication, due to installation of the temperature control unit at the lower portion of the freezer door FD immediately above the refrigerator door RD, not only is the use of a relatively long electric wiring 11 made up of a bundle of electric lines is required. This arrangement tends to bring about an increase in cost. Also, the render information displayed through the display windows 26 is rather difficult to read. Also, considering that adjustment of the temperatures inside the freezing compartment and the refrigerating compartment requires the associated slide door segments 27 to be opened and then closed before and after the user presses the adjustment buttons mounted on the control panel 9, respectively, the repeated opening and closure of the slide doors over a long period of use would eventually result in damage to one or both of the slide door segments 27 to such an extent as to bring about reduction in aesthetic appearance of the refrigerator.

In addition, the temperature control unit may be damaged or malfunction when the freezer door FD opened and the lower portion thereof collides inadvertently against, for example, a cupboard or cabinet positioned next to the refrigerator.

SUMMARY OF INVENTION

Accordingly, the present invention has been devised with a view to substantially eliminating the above discussed problems which are inherent in the prior art temperature control devices used in the refrigerators and is intended to provide an improved temperature control unit which is effective to accomplish a maximized utilization of the space available in the refrigerator, which can easily and comfortably be handled without forcing the user to assume an awkward posture and which is simple in structure and easy to install at a location where the temperature control unit is less susceptible to damage.

To this end, the present invention, briefly speaking, is featured in that the temperature control unit is embedded in a side portion of the inner box forming a part of the refrigerator housing. With the temperature control unit so embedded, not only is the maximized utilization of the space available in the refrigerator possible, but the user can have an easy visual confirmation and comfortable access to the temperature control unit with no need to assume an awkward position and the temperature control unit itself can be mounted in a safe position at a reduced cost.

According to the present invention, there is provided a temperature control device in a refrigerator having at least one compartment defined by top, bottom and opposite side walls, and a heat insulating material exteriorly encircling the compartment. One of the side walls has a mounting hole defined therein and thereof a front surface thereof confronting the compartment. The device includes a box-like console, a circuit carrier board fixedly connected to a rear surface of the console and having an electric wiring extending outwardly therefrom, a display panel disposed on a front surface of the console, at least one manipulatable temperature control element mounted on the console, a hat-like console casing having a peripheral flange and fixedly secured to the side wall in alignment with the mounting hole with the peripheral flange held in abutment with a rear surface of the side wall so as to define a console pocket, and a plurality of mounting elements engageable with one side edge of the side wall around the mounting hole for securement of the console to the side wall. The console is received in the console pocket with the electric wiring accommodated within the console pocket and with the display panel and the temperature control element confronting the compartment.

Preferably, the temperature control element may be a temperature control knob having a finger recess defined therein for engagement by a user's finger. Alternatively, the temperature control element may comprise a temperature control push-button and a plurality of light emitting elements for the display of a temperature selected.

Preferably, the console includes a peripheral flange protruding transversely from the rear surface of the console and encircling the circuit carrier board and at least one rib formed on an upper wall portion of the peripheral flange and positioned behind the mounting element.

Preferably, the console casing has a bottom wall lying parallel to the side wall and spaced in opposition to the mounting hole and two parallel upright ribs are formed on the bottom wall of the console casing for snugly accommodating the electric wiring. Instead of the two parallel upright ribs, a plurality of wire catches may be employed.

Also preferably, a front side wall portion of the side wall adjacent the opening leading to the compartment is inclined relative to the remaining side wall portion of the side wall and in that the mounting hole is defined in the front side wall portion.

The console may be pivotally mounted in the mounting hole and has a top wall formed with a guide slot, in which case a slidable anchor member is slidably fitted to the rear surface of the side wall for engagement in the guide slot to define the stroke of pivotal movement of the console.

BRIEF DESCRIPTION OF DRAWINGS

The present invention will become readily understood from the following description of preferred embodiments thereof made with reference to the accompanying drawings, in which like parts are designated by like reference numeral and in which.

DETAILED DESCRIPTION OF

Figure 12:
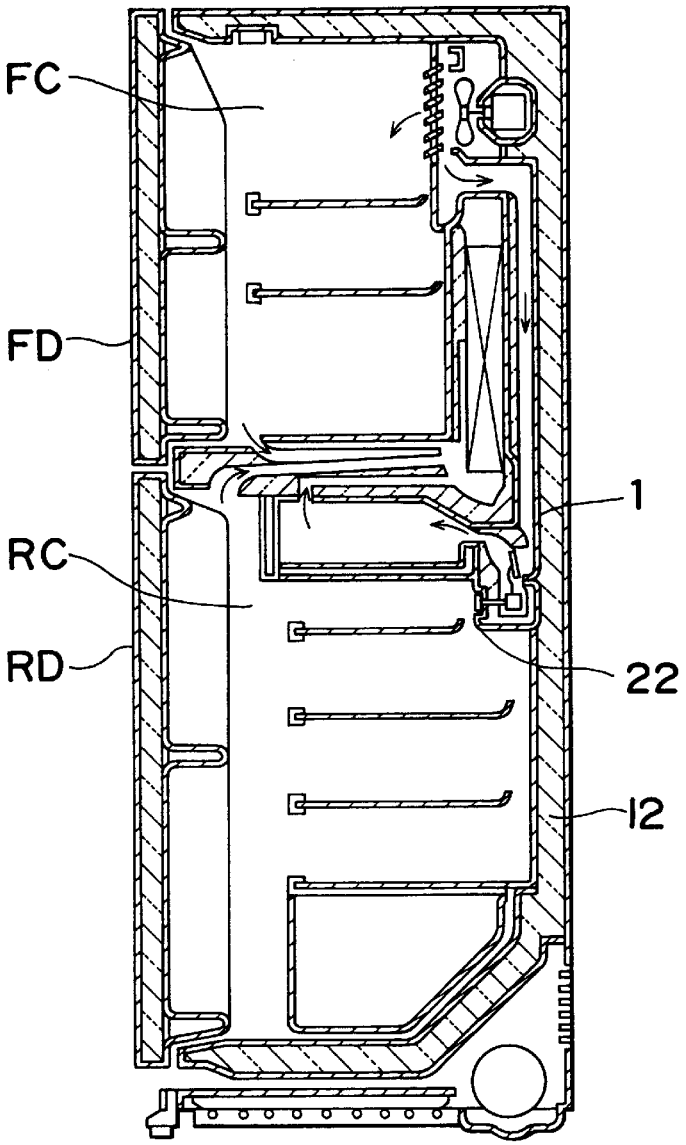
FIG. 12 is a longitudinal sectional view of a refrigerator showing the position of a conventional temperature control unit.
Figure 13:
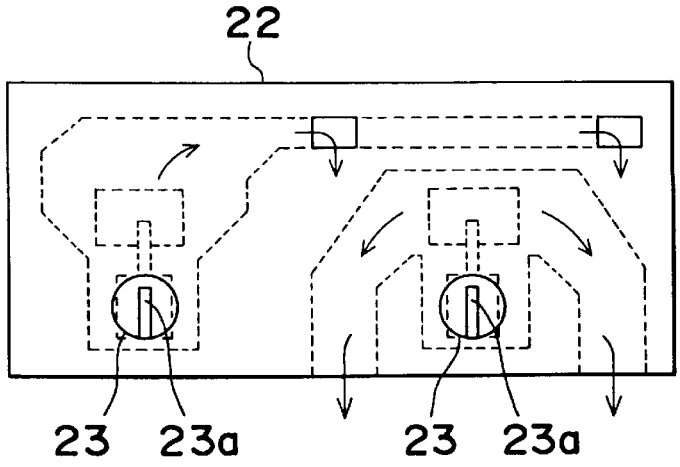
FIG. 13 is a schematic front elevational view of the conventional temperature control unit shown in FIG. 12.

The refrigerator to which the present invention is applicable may be of any known structure such as that shown in FIG. 12 or may have at least one compartment for refrigerating foodstuffs accommodated therein. However, for the purpose of description of the present invention, reference is made to the refrigerator of a type having a freezing compartment, a refrigerating compartment, and a chilling compartment in the form of a sliding drawer box for storing foodstuffs at a low temperature which is adjustable within the range of, for example, −5° C. to 8° C., preferably 5° C. to 7° C. for storing vegetables.

(First Embodiment)

Figure 1:
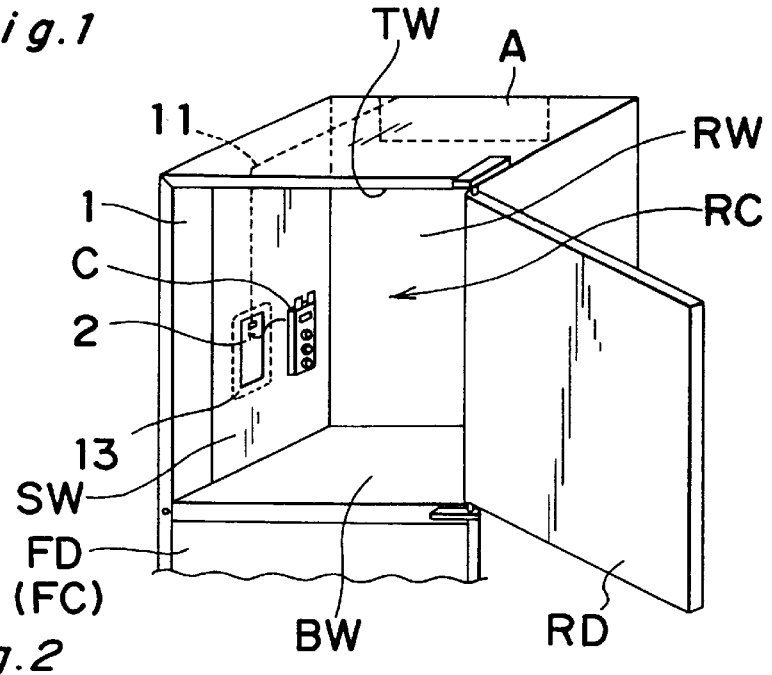
FIG. 1 is a schematic perspective view of a top portion of a refrigerator in which a temperature control unit according to a first preferred embodiment of the present invention is installed.
Figure 2:
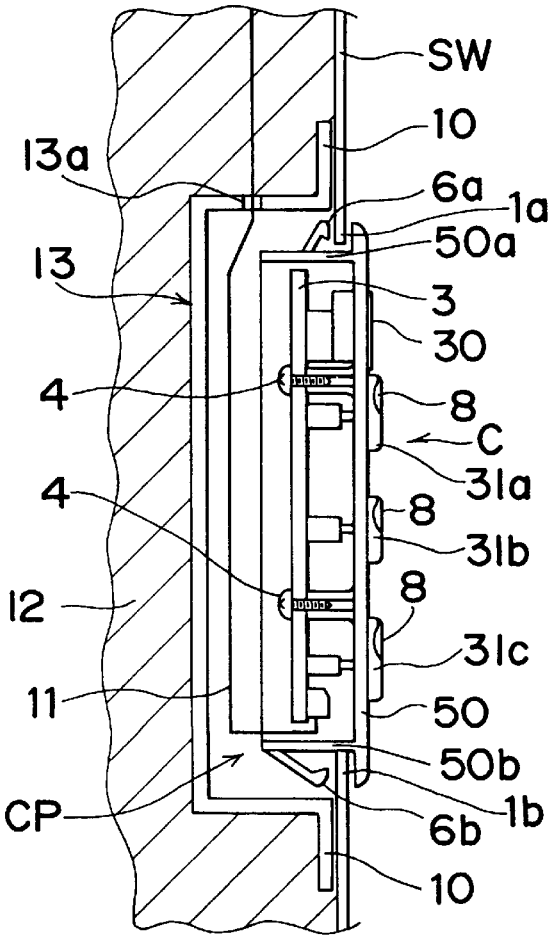
FIG. 2 is a fragmentary longitudinal sectional view, on an enlarged scale, showing the temperature control unit shown in FIG. 1.

Referring now to FIGS. 1 and 2, the refrigerator comprises a rectangular box-like housing of a double-walled structure including outer and inner boxes with a heat insulating material 12 filled in a space between the outer and inner boxes. The refrigerator shown therein is of a type wherein the inner box is divided into a freezing compartment FC adapted to be opened or closed selectively by a freezer door FD and a refrigerating compartment RC located, for example, above the freezing compartment FC and adapted to be opened or closed selectively by a refrigerator door RD. The refrigerating compartment RC is delimited by a top wall TW, a bottom wall BW, a rear wall RW and opposite side walls SW, which form respective parts of the inner box 1 of the refrigerator housing. The-rear wall RW confronts the refrigerator door RD.

One of the opposite side walls SW of the inner box 1 is formed with a generally rectangular mounting hole 2 at a location adjacent the opening of the refrigerating compartment RC or adjacent the refrigerator door RD when the latter is in position to close the opening of the refrigerating compartment RC. A generally rectangular hat-like console casing 13 having a peripheral flange 10 is embedded in the insulating material 12 with its opening aligned with the mounting hole 2 and with its peripheral flange 10 fixedly held in abutment with a rear surface of the peripheral lip region of the side wall SW around the mounting hole 2, to thereby complete a console pocket CP. It is to be noted that, for the reason which will become clear from the subsequent description, the opening of the hat-like console casing 13 is oversized relative to the opening of the mounting hole 2 so that at least upper and lower, opposite portions of the peripheral lip region of the side wall SW around the mounting hole 2 can protrude a distance inwardly of the mounting hole 2 to thereby define respective engagement pawls 1*a* and 1*b*.

A generally box-like console C includes a generally rectangular front panel 50 having a generally rectangular peripheral flange 50*a* (or 50*b*) formed integrally therewith. The peripheral flange 50*a* (or 50*b*) protrudes from a rear surface thereof in a direction transverse thereto and are positioned at respective locations set a distance backwardly from upper and lower ends of the front panel 50. This peripheral flange 50*a* (or 50*b*) has upper and lower wall portions which are opposite to each other and are integrally formed with respective upper and lower tongues 6*a* and 6*b*. The upper and lower tongues 6*a* and 6*b* extend slantwise and outwardly from the upper and lower wall portions of the peripheral flange 50*a* (or 50*b*) so as to terminate at a position spaced from the adjacent upper and lower ends of the front panel 50*a* distance substantially equal to or slightly smaller than the thickness of the upper engagement pawls 1*a* and 1*b*, respectively.

The console C also includes a circuit carrier board 3 spacedly fixed to the rear surface of the front panel 50 by means of a plurality of set screws 4, a display panel 30 disposed on a front surface of the front panel 50 for providing a visual indication of the status of operation of the refrigerator, for example, occurrence of trouble in the refrigerator, and three temperature control knobs 31*a*, 31*b* and 31*c* disposed on the front surface of the front panel 50. The control knobs are used to adjust the temperature inside the chilling chamber (not shown), the temperature inside the refrigerating compartment and the temperature inside the freezing compartment, respectively. Each of the temperature control knobs 31*a*, 31*b* and 31*c* has a finger recess 8 defined therein for the access of a user's finger therin it is desired to turn one of the knobs 31*a*, 31*b* or 31*c* is desired to be turned for adjustment of the temperature inside the corresponding compartment.

The console C of the structure described above is accommodated within the console pocket CP in the following manner. When the console C carrying the circuit carrier board 3 is, after having been aligned with the mounting hole 2, pushed into the console pocket CP with the upper and lower engagement pawls 1*a* and 1*b* sliding over the upper and lower tongues 6*a* and 6*b* causing the latter to resiliently yield while resiliency in sliding contact with the upper and lower engagement pawls 1*a* and 1*b*. Simultaneously with complete insertion of the console C into the console pocket CP with the upper and lower ends of the front panel 50 held in contact with the upper and lower engagement pawls 1*a* and 1*b* from out-side, the upper and lower tongues 6*a* and 6*b* are erected due to their own resiliency so as to thereby clamp the upper and lower engagement pawls 1*a* and 1*b* in cooperation with the upper and lower ends of the front panel 50, respectively, as shown in FIG. 2.

With the console C received securely within the console pocket CP in the manner as hereinabove described, electric wiring 11 made up of a bundle of electric lines extending outwardly from the circuit carrier board 3, extends into a space that is delimited by the console casing 13 and the console C and then to an electric power source circuit A through a perforation 13*a* defined in an upper wall portion of the console casing 13 in the insulating material 12.

Figure 14:
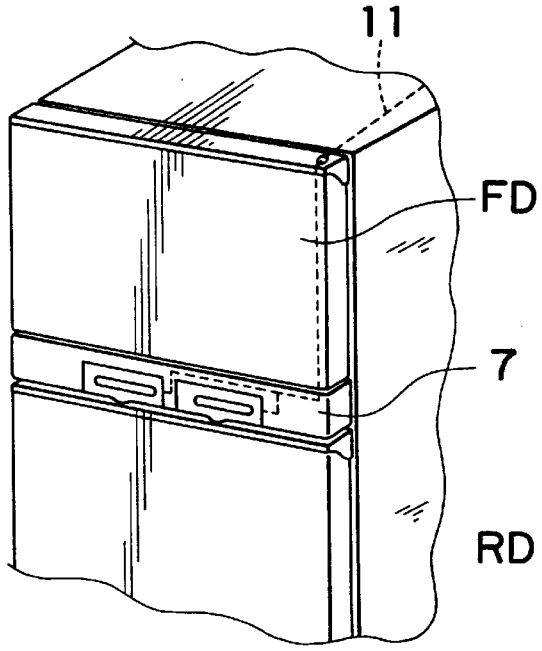
FIG. 14 is a schematic view showing another conventional temperature control unit.
Figure 15:
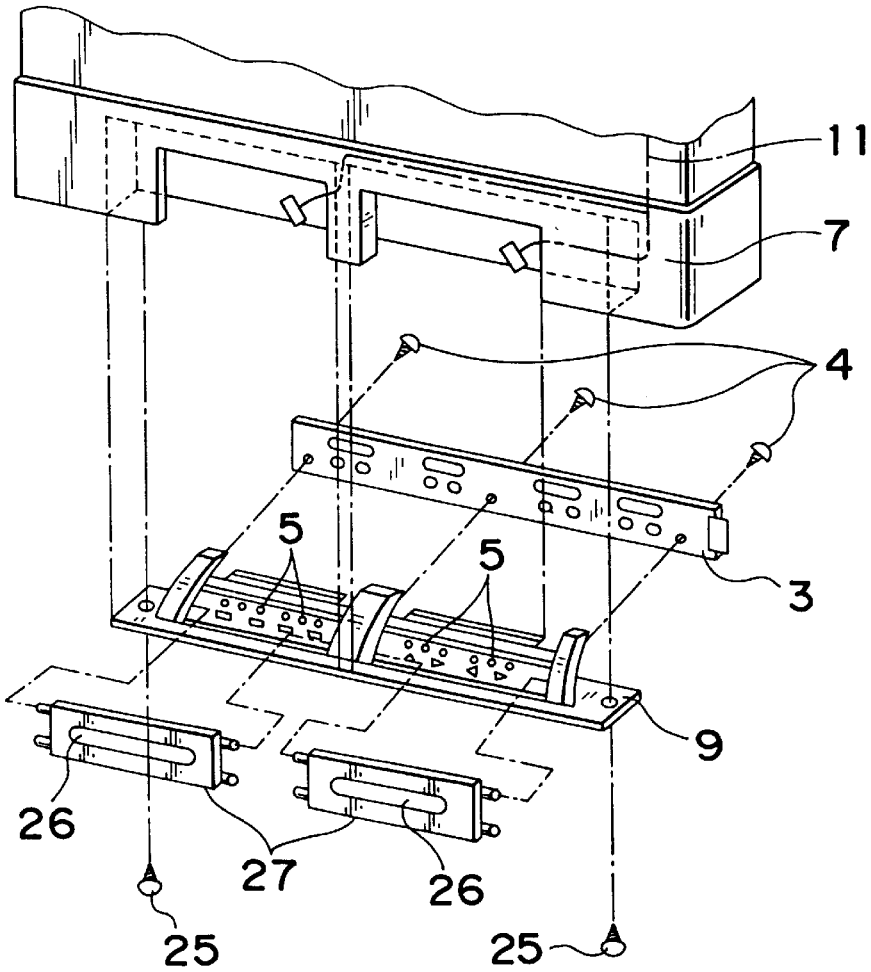
FIG. 15 is an exploded view, on an enlarged scale, showing the conventional temperature control unit of FIG. 14.

Considering that the console C including the temperature control knobs 31*a* to 31*c*, is installed at a portion of one of the side walls SW adjacent the opening leading into the refrigerating compartment RC which occupies a top region of the refrigerator as a whole, it is clear that not only the utilization of the space within the refrigerating compartment RC can be maximized, but also the user can gain with easy and comfortable access to the console C with without the need to assume an awkward posture. Also, the console C is substantially free from damage which could occur when it is installed in the door such as discussed in connection with the prior art shown in FIGS. 14 and 15, Also the length of the electric wiring 11 can be reduced as compared with that employed in the prior art temperature control unit shown in FIGS. 14 and 15. The user can also easily visually confirm information displayed on the display panel 30 disposed on the front panel 50 of the console C and used to provide an visual indication of the status of operation of the refrigerator.

(Second Embodiment)

Figure 3:
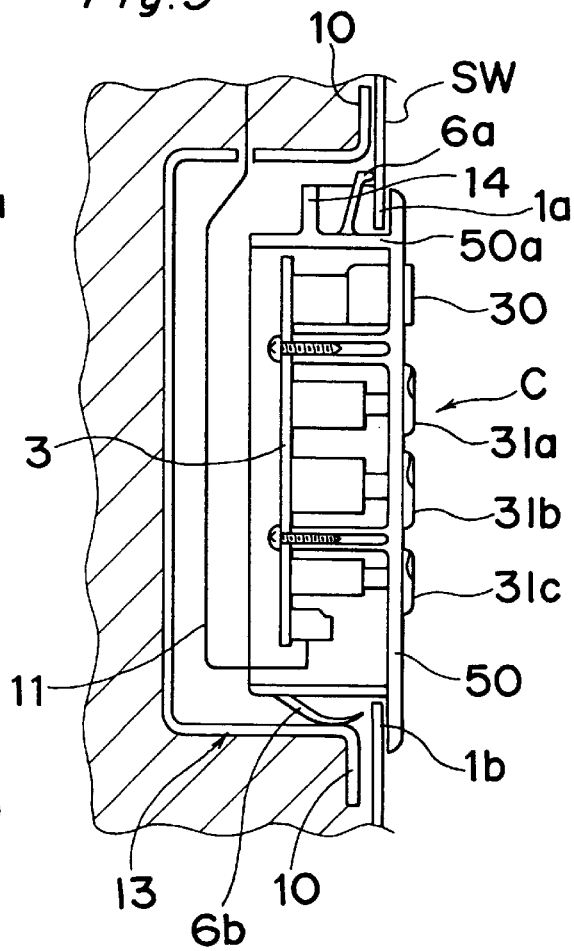
FIG. 3 is a view similar to FIG. 2, showing the temperature control unit according to a second preferred embodiment of the present invention.
Figure 4:
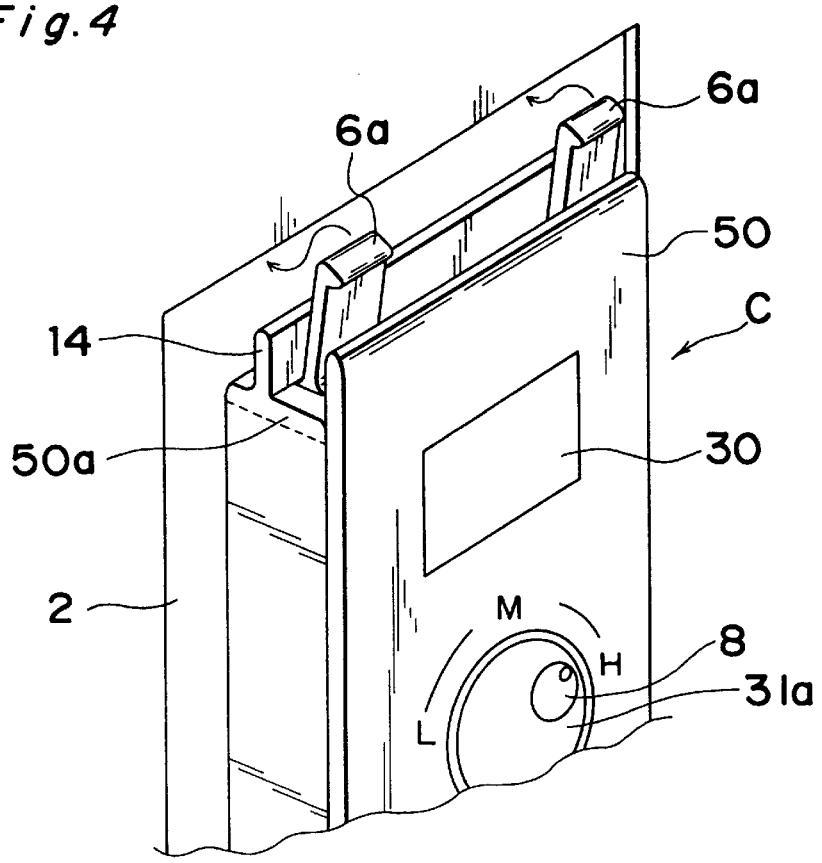
FIG. 4 is a fragmentary perspective view of a portion of the temperature control unit shown in FIG. 3.

In the embodiment shown in FIGS. 3 and 4, the upper wall portion of the peripheral flange 50*a* is integrally formed with at least one transverse rib 14 positioned thereon in the same side of the upper tongues 6*a* in parallel to the front panel 50. The rib 14 protrudes upwardly therefrom a distance which smaller than the height of each upper tongue 6*a* as measured upwardly from the upper wall portion of the peripheral flange 50*a*. Also, the rib 14 extends in a direction that is widthwise of the console C and parallel to the plane of the front panel 50.

The transverse rib 14 serves as a means for avoiding or preventing any possible ingress of condensed droplets of condensed water into the space inside the peripheral flange 50*a* where the circuit carrier board 3 is disposed. More specifically, without the transverse rib 14, droplets of water formed by condensation of a vapor component and sticking to the side wall SW will enter in between the side wall SW and the upper end of the front panel 50 and then flow backwardly along the upper wall portion of the peripheral flange 50*a* and into the space inside the peripheral flange 50*a*. The presence of the transverse rib 14 is effective to guide the droplets of water laterally therealong so as to flow downwards along opposite side wall portions of the peripheral flange 50*a* to thereby avoid the ingress of the water droplets into the space inside the peripheral flange 50*a*.

In the embodiment shown in FIGS. 3 and 4, although the lower tongues 6*b* may be functionally identical with those shown in and described in connection with the foregoing embodiment, they are rather used to serve as leaf springs for biasing the console C as a whole upwardly after the console C has been completely received in the console pocket CP. More specifically, the console C employed in the second embodiment of the present invention shown in FIGS. 3 and 4 is mounted in the console pocket CP by first allowing the upper engagement pawl 1*a* to be received between the upper tongues 6*a* and the upper end of the front panel 50 and then pushing a lower portion of the console C towards the console pocket CP with the lower tongues 6*b* sliding over the lower engagement pawl 6*b* while resiliently yielding due to their own resiliency. Upon complete of insertion of the console C into the console pocket CP, the lower tongues 6*b* restore to their original shape by the effect of their own resiliency, thereby biasing the console C as a whole upwardly.

The use of the lower tongues 6*b*, which serve as leaf springs, is effective to accommodate a variation in dimension or completeness of the console C relative to the size of the console pocket CP and also to facilitate a cursory mounting of the console C in the console pocket CP.

(Third Embodiment)

In this third embodiment of the present invention, an upright bottom wall of the console casing 13 defining the bottom of the console pocket CP is formed with a pair of vertically extending, juxtaposed upright ribs 15 which are spaced from each other a distance sufficient to accommodate the bundled electric lines forming the electric wiring 11. Also, the ribs 15 protrude toward the console C a distance that is sufficient to avoid the bundled electric lines from being bitten between the bottom wall of the console casing 13 and the console C when the latter is mounted in the console pocket CP. With the juxtaposed ribs 15, one or some of the bundled electric lines of the electric wiring 11 can be advantageously avoided from being broken during servicing or replacement of the console C.

(Fourth Embodiment)

Figure 5:
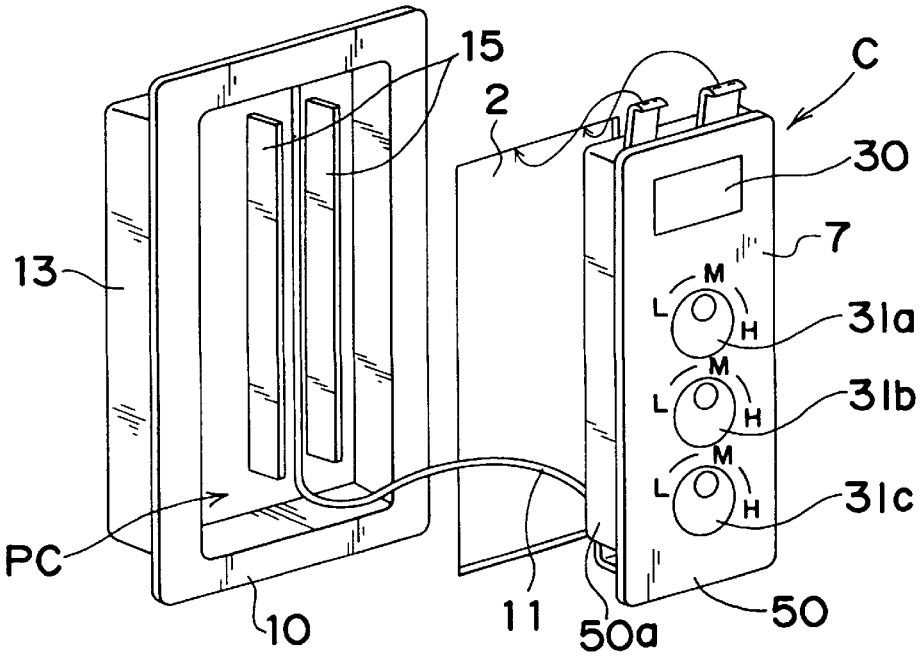
FIG. 5 is a schematic exploded view showing the temperature control unit according to a third preferred embodiment of the present invention.
Figure 6:
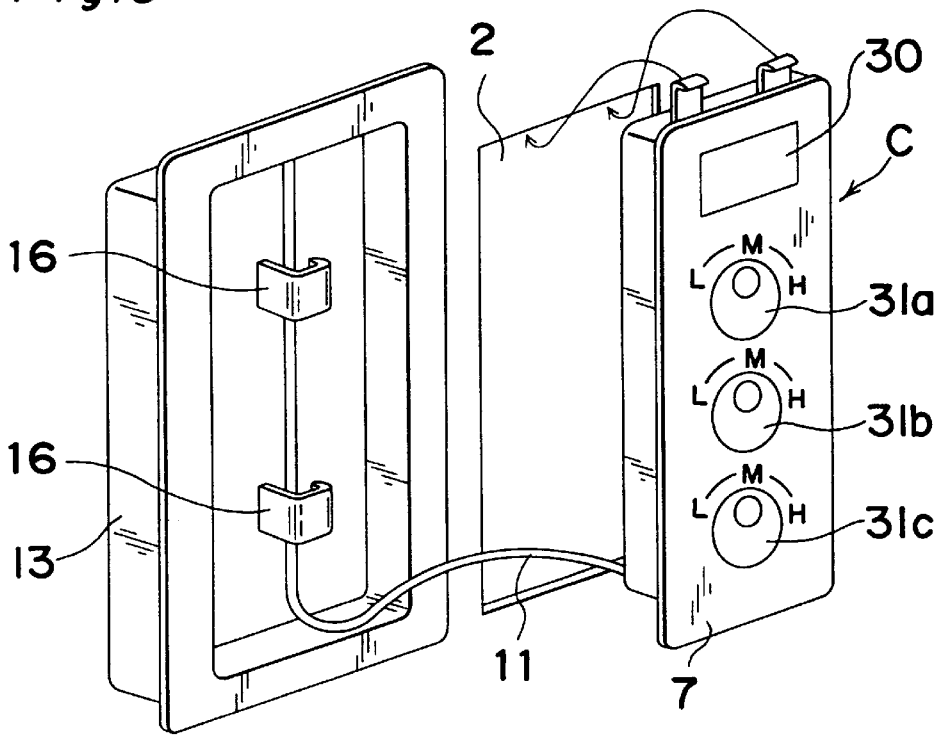
FIG. 6 is a schematic exploded view showing the temperature control unit according to a fourth preferred embodiment of the present invention.
Figure 7:
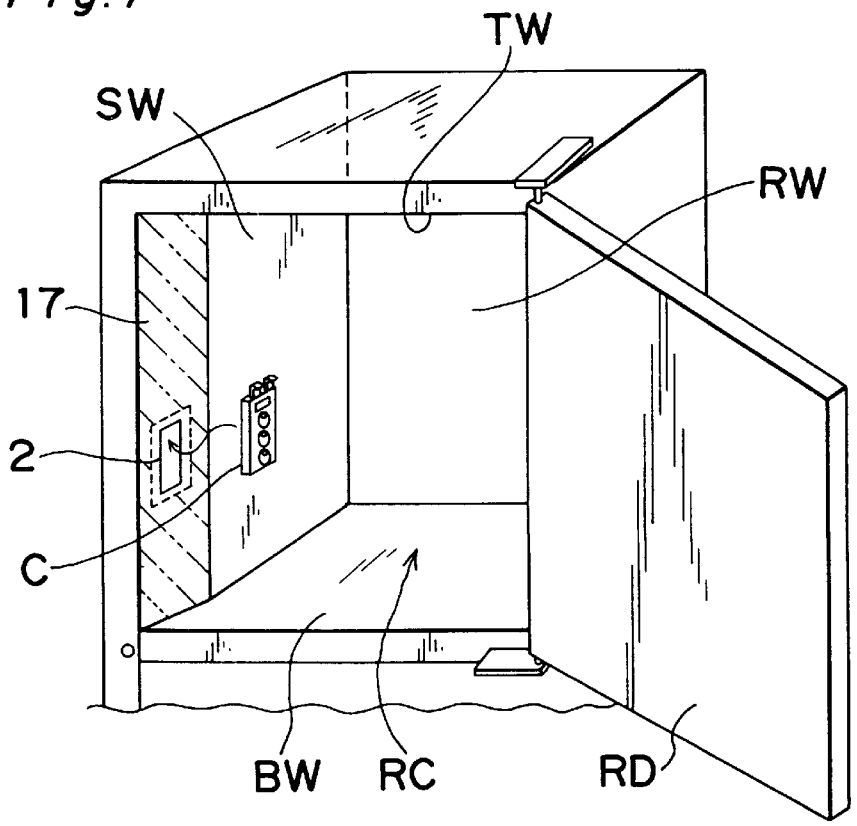
FIG. 7 is a view similar to FIG. 1, showing the temperature control unit according to a fifth preferred embodiment of the present invention.

In this embodiment of the present invention, in place of the juxtaposed upright ribs 15 shown in FIG. 5, the upright bottom wall of the console casing 13 is formed with a plurality of, for example, two, generally L-shaped cable catches 16 to avoid a loosening of the electric wiring 11.

Since these cable catches 16 are effective to avoid an arbitrary meandering of the electric wiring 11 as is the case with the upright ribs 15 shown in FIG. 5 during servicing or replacement of the console C, inadvertent breakage of one or some of the bundled electric lines of the electric wiring 11 can be effectively avoided.

(Fifth Embodiment)

Figure 8:
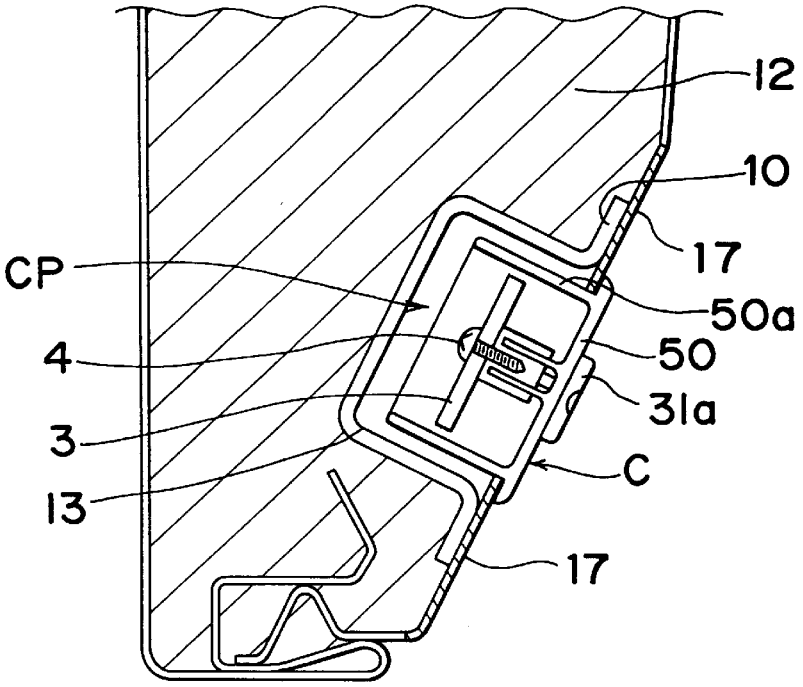
FIG. 8 is a fragmentary sectional view, on an enlarged scale, showing a portion of the temperature control unit of FIG. 7 as viewed from top.

In this embodiment, at least one of the opposite side walls SW of the inner box 1 defining the refrigerating compartment RC has a front side wall portion 17 which inclined relative to the remaining side wall portion of the one side wall SW such that as viewed from the top as shown in FIG. 8, the associated side wall of the refrigerating compartment RC has a wall thickness progressively decreasing towards a front side rim that is flush with the opening leading into the refrigerating compartment RC. The mounting hole 2 referred to above is defined in the inclined front side wall portion 17 of the side wall SW. The console C is mounted in the console pocket CP in a manner similar to that described in connection with any one of the first and second embodiments of the present invention.

Since the inclined front side wall portion 17 diverges from the remaining side wall portion so as to face towards the opening leading into the refrigerating compartment RC rather than towards the opposite side wall SW, therefore the user can easily and conveniently view the display panel 30 in the console C, and also can easily access any one of the temperature control knobs 31*a* to 31*c*.

(Sixth Embodiment)

Figure 9:
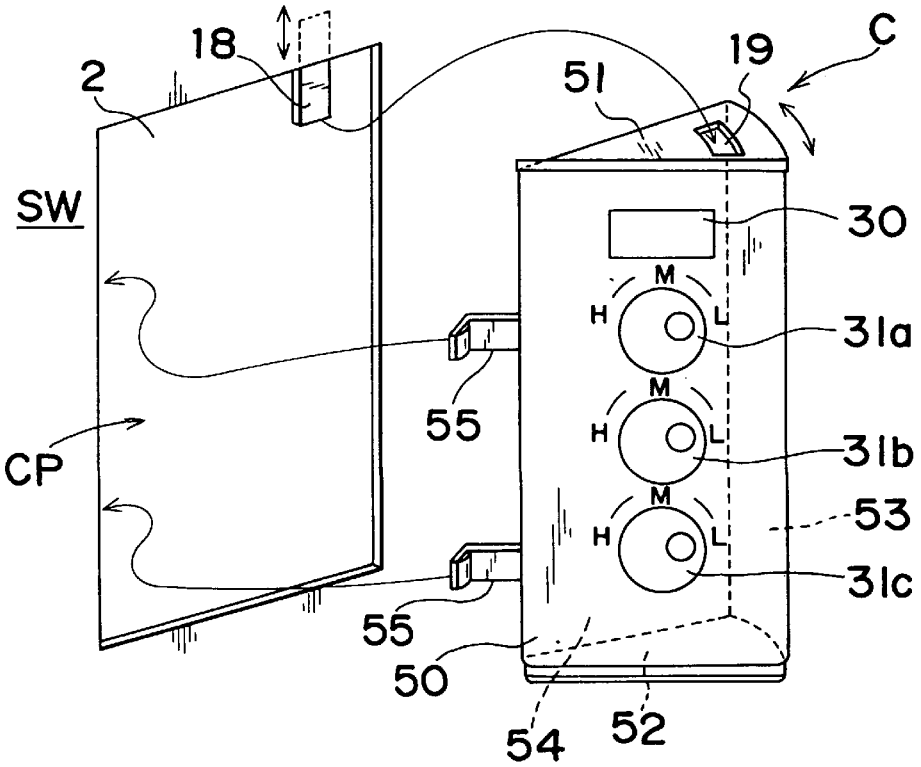
FIG. 9 is a schematic exploded view showing the temperature control unit according to a sixth preferred embodiment of the present invention.
Figure 10:
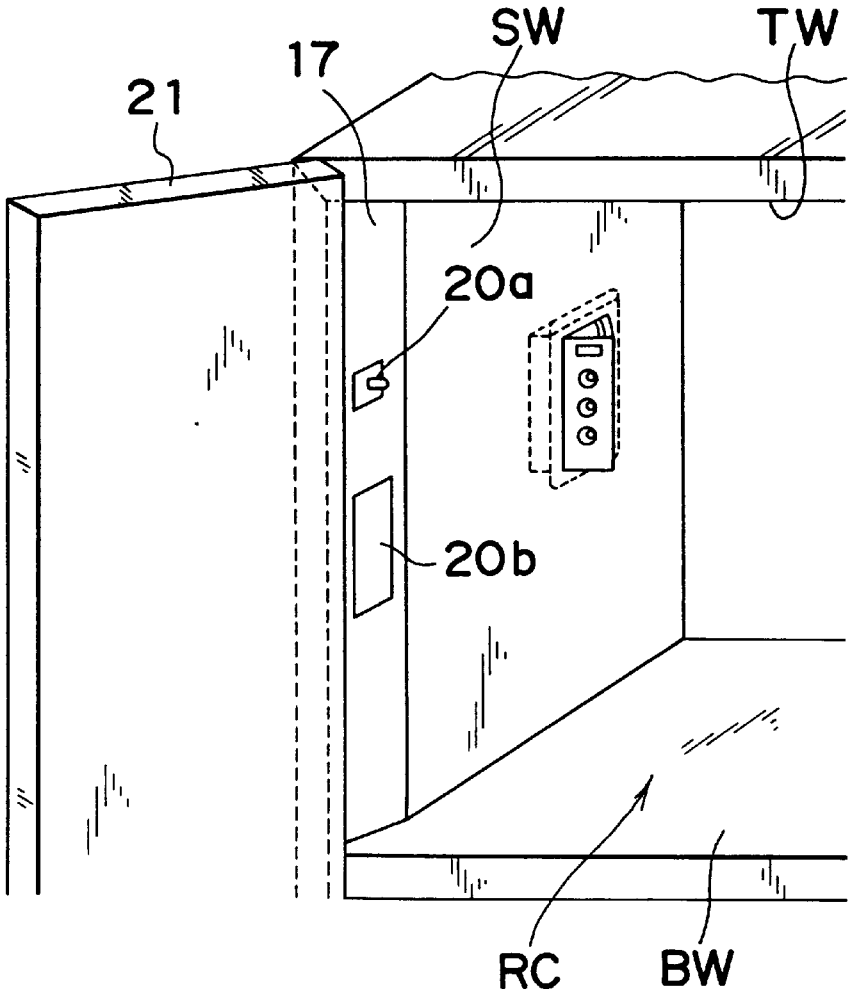
FIG. 10 is a view similar to FIG. 1, showing the temperature control unit of FIG. 9.

The console C as shown in FIGS. 9 and 10, is of a configuration having a generally triangular cross-section including, in addition to the front panel 50, generally sector-shaped top and bottom panels 51 and 52, a substantially arcuately sectioned side wall 53 and a rear panel 54. The top panel 51 is formed with a curved guide slot 19 defined therein so as to follow the curvature of the arcuate side wall 53. The console C also includes a pair of anchor arms 55 protruding laterally and outwardly from around a joint between the front panel 50 and the rear panel 54. The console C is pivotally mounted in the console pocket CP with the anchor arms 55 non-detachably anchored to behind a left side edge of the mounting hole 2 in any suitable manner. The side wall SW has a slidable pin 18 supported for movement up and down as shown by the arrow, said slidable pin 18 being engaged in the curved guide slot 19 once the console C has been mounted in the console pocket CP.

Thus, it will readily be seen that the console C can be pivoted about the hinge defined by points of connection between the anchor arms 55 and the side edge of the mounting hole 2 between a folded position, in which the front panel 50 lies substantially parallel to the adjacent side wall SW, and a drawn position as shown in FIG. 10. The stroke of movement of the console C is limited by the size of the curved guide slot 19 in cooperation with the slidable pin 18 that is loosely engaged therein.

Figure 11:
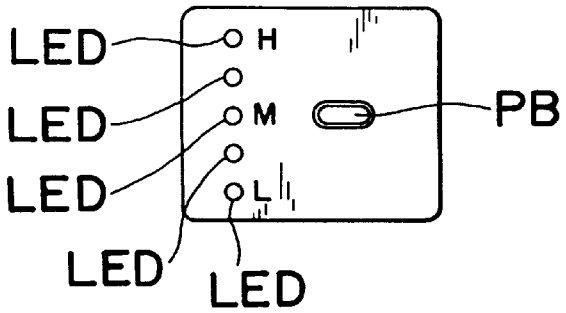
FIG. 11 is a schematic diagram showing a push-button type temperature control which can be employed in place of a knob-type temperature control employed in the temperature control unit according to any one of the preferred embodiments of the present invention.

The mounting of the console C in the manner shown in FIGS. 10 and 11 is particularly advantageous where the inclined front side wall portion 17 is not available for the console C because a door switch 20*a* and a label 20*b* setting forth instructions of how to use the refrigerator are disposed on the inclined front side wall portion 17 as shown in FIG. 10. In such a situation, there will be no way other than to locate the console C in the side wall SW at a position somewhat a distance inwardly from the opening leading to the refrigerating compartment RC and, accordingly, to provide ready access to the temperature control knobs 31*a* to 31*c* and also to the display panel 30. The console C is pivotally mounted as discussed hereinabove.

(Modification)

In describing any one of the foregoing preferred embodiments of the present invention, the temperature control unit has been shown and described as having the temperature control knobs 31*a* to 31*c*. However, in place of the temperature control knobs 31*a* to 31*c*, push-button controls may be employed. Each push-button control includes, as shown in FIG. 11, a pushbutton PB and a row of light emitting elements LED, each of which provides a visual indication of a selected varying temperature when lit.

As a matter of course, only one or two of the temperature control knobs may be replaced with the push-button control or controls to allow the console C to have a combination of the temperature control knob or knobs and the push-button type temperature controls or control.

The use of the light emitting elements to provide a visual indication of the selected temperature inside the refrigerating compartment highlights the visibility as compared with calibrations used in connection with any of the temperature control knobs 31*a* to 31*c*.

As described above, in the improved temperature control unit of the present invention, a maximized utilization of the space available in the can be obtained. The improved control unit can easily and comfortably be handled without forcing the user to assume an awkward posture. The control is simple in structure and easy to install at a location where the temperature control unit is less susceptible to damage. That is, since the temperature control unit is embedded in a side portion of the inner box forming a part of the refrigerator housing, not only maximized utilization of the space available in the refrigerator possible, but the user can also have an easy visual confirmation and comfortable access to the temperature control unit with no need to assume an awkward position and the temperature control unit itself can be mounted in a safe position at a reduced cost.

Although the present invention has been described in connection with the preferred embodiments thereof, it should be noted that various changes and modifications will be apparent to those skilled in the art. For example, although in any one of the foregoing embodiments the refrigerator has been described having three compartments, the present invention is equally applicable where the refrigerator has only one refrigerating or freezing compartment and, in such case, the three temperature control knobs or pushbuttons need not be employed, but the only temperature control knob or push-button suffices.

Accordingly, such changes and modifications so far as encompassed by the appended claims are to be understood as included within the scope of the present invention.

What is claimed is:

1. A refrigerator comprising:

a refrigerator housing including an inner box, an outer box surrounding said inner box, and insulating material disposed between said inner and outer boxes, said inner box defining at least one compartment having a top wall, a bottom wall and opposite side walls, wherein one of said side walls has a mounting hole formed therein;

a refrigerator door connected to said refrigerator housing for selectively opening and closing said compartment; and a temperature control device disposed in said mounting hole which is formed in the one of said side walls of said inner box, said temperature control device having a console which includes a carrier board and a peripheral flange, said peripheral flange having a water draining portion formed on an upper wall surface thereof for preventing the entrance of water droplets.

2. The refrigerator as claimed in claim 1, wherein said console casing further comprises:

a bottom wall which is parallel to the one side wall and spaced from said mounting hole; and two ribs for accommodating said electric wiring therebetween, said ribs projecting from the bottom wall of said console casing.

3. The refrigerator as claimed in claim 1, wherein said console casing further comprises:

a bottom wall which is parallel to the one side wall and spaced from said mounting hole; and a plurality of catch members for trapping said electric wiring, said catch members projecting from the bottom wall of said console casing.

4. The refrigerator as claimed in claim 1, wherein the one side wall includes a front side wall portion that is angled relative to the remaining portion of the one side wall, and said mounting hole is disposed in said front side wall portion.

5. The refrigerator as claimed in claim 1, wherein said console is pivotally mounted in said mounting hole.

6. The refrigerator as claimed in claim 5, further comprising:

a guide slot formed in a top wall of said console; and an anchor member slidably fitted to the outer peripheral surface of the one side wall at said mounting opening, wherein said anchor member is received in said guide slot to limit the pivotal movement of said console.

7. The refrigerator as claimed in claim 1, wherein said water draining portion comprises an upstanding transverse rib.

8. The refrigerator as claimed in claim 1, wherein said peripheral flange encircles said circuit carrier board, and said water draining portion comprises an upstanding transverse rib projecting from the upper wall of said peripheral flange.

9. A refrigerator comprising:

a refrigerator housing including an inner box, an outer box surrounding said inner box, and insulating material disposed between said inner and outer boxes, said inner box defining at least one compartment having a top wall, a bottom wall and opposite side walls, wherein one of said side walls has a mounting hole formed therein;

a refrigerator door connected to said refrigerator housing for selectively opening and closing said compartment; and a temperature control device including:

a) a console casing aligned with said mounting hole and having a peripheral flange fixedly secured to the sidewall of said inner box so as to define a console pocket;

b) a console disposed in said console pocket, said console having a front panel, a carrier board fixed secured to a rear surface of said front panel, and a peripheral flange extending rearwardly from said front panel, said peripheral flange having a water draining portion formed on an upper wall surface thereof for preventing the entrance of water droplets;

c) electric wiring extending outwardly from said temperature control device;

d) a display panel disposed on a front surface of said front panel;

e) at least one manipulatable temperature control element mounted on said front panel; and f) a plurality of mounting elements engagable with an outer peripheral surface of the one side wall in the vicinity of said mounting hole in order to secure said console to the one side wall so that said display panel and said temperature control element confront the compartment and said electric wiring is accommodated within the console pocket.

10. The refrigerator as claimed in claim 9, wherein said console casing further comprises:

a bottom wall which is parallel to the one side wall and spaced from said mounting hole; and two ribs for accommodating said electric wiring therebetween, said ribs projecting from the bottom wall of said console casing.

11. The refrigerator as claimed in claim 9, wherein said console casing further comprises:

a bottom wall which is parallel to the one side wall and spaced from said mounting hole; and a plurality of catch members for trapping said electric wiring, said catch members projecting from the bottom wall of said console casing.

12. The refrigerator as claimed in claim 9, wherein the one side wall includes a front side wall portion that is angled relative to the remaining portion of the side wall, and said mounting hole is disposed in said front side wall portion.

13. The refrigerator as claimed in claim 9, wherein said console is pivotally mounted in said mounting hole.

14. The refrigerator as claimed in claim 13, further comprising:

a guide slot formed in a top wall of said console; and an anchor member slidably fitted to the outer peripheral surface of the one side wall at said mounting opening, wherein said anchor member is received in said guide slot to limit the pivotal movement of said console.

15. The refrigerator as claimed in claim 9, wherein said water draining portion comprises an upstanding transverse rib.

16. The refrigerator as claimed in claim 9, wherein said peripheral flange encircles said circuit carrier board, and said water draining portion comprises an upstanding transverse rib projecting from the upper wall of said peripheral flange.

* * * * *